United States Patent [19]

Lofgren

[11] Patent Number: 4,819,347

[45] Date of Patent: Apr. 11, 1989

[54] SYSTEM FOR REMOVING SUBMERGED SANDWAVES

[75] Inventor: Robert W. Lofgren, Vancouver, Wash.

[73] Assignee: Riedel International, Inc., Portland, Oreg.

[21] Appl. No.: 144,959

[22] Filed: Jan. 19, 1988

[51] Int. Cl.[4] ..... E02F 5/28

[52] U.S. Cl. ..... 37/78; 37/79; 37/195

[58] Field of Search ..... 37/78, 79, 195

[56] References Cited

U.S. PATENT DOCUMENTS

| | | | |
|---|---|---|---|
| 260,200 | 6/1882 | Huffer . | |
| 284,387 | 9/1883 | Cornelius et al. . | |
| 294,303 | 2/1884 | Anderson . | |
| 296,483 | 4/1884 | Stone . | |
| 423,716 | 3/1890 | Baker . | |
| 486,957 | 11/1892 | Schaffer . | |
| 723,122 | 3/1903 | Andersen . | |
| 2,318,587 | 5/1943 | Andrews, Jr. . | |
| 3,402,487 | 9/1968 | Vaughan et al. | 37/78 |
| 3,440,743 | 4/1969 | Divine | 37/79 |
| 3,599,354 | 8/1971 | Larson | 37/78 |
| 4,073,078 | 2/1978 | Leitz . | |

FOREIGN PATENT DOCUMENTS

| | | | |
|---|---|---|---|
| 1408393 | 10/1975 | United Kingdom | 37/78 |

*Primary Examiner*—Clifford D. Crowder

*Attorney, Agent, or Firm*—Chernoff, Vilhauer, McClung & Stenzel

[57] ABSTRACT

An apparatus for removing submerged sandwaves includes a transversely elongate manifold having an array of parallel, transversely spaced-apart fluid jets and an elongate eductor plate parallel to and spaced apart from the manifold so as to form a transverse orifice therebetween located above the outlets of the jets. The manifold and eductor plate are suspended above the riverbed by a pair of trailing arms pivotally connected to a barge. A pump on the barge takes water out of the river and pumps it down one of the trailing arms to the submerged manifold where it is ejected from the jets of the array in a transversely-extending, substantially planar flow parallel to the riverbed. The decreased pressure of the high-velocity water ejected from the jets draws surrounding river water down through the orifice between the manifold and the eductor plate adding significantly to the volumetric flow rate, and the combined flow errodes the riverbed.

11 Claims, 2 Drawing Sheets

SYSTEM FOR REMOVING SUBMERGED SANDWAVES

BACKGROUND OF THE INVENTION

This invention relates to the dredging of submerged sedimentary material, and particularly to a system and apparatus for removing submerged sandwaves employing an eductor principle.

The technique of hydraulic dredging, using submerged jets of water to remove sandbars or cut channels in riverbeds, is well known as exemplified by Andrews U.S. Pat. No. 2,318,587, Baker U.S. Pat. No. 423,716, Huffer U.S. Pat. No. 260,200, and Cornelius et al. U.S. Pat. No. 284,387. Some dredging systems use mechanical action, as well as hydraulic action, as exemplified by Schaffer U.S. Pat. No. 486,957, Stone U.S. Pat. No. 296,483, Anderson U.S. Pat. No. 294,303 and Andersen U.S. Pat. No. 723,122. The dredging systems disclosed in Schaffer and Andrews employ an array of spaced-apart water jets. However, all of these devices suffer from the same limitations on their productivity, i.e. equipment and power limitations on the volumetric flow rate at which the water can be pumped through the jets, and the proportionality between rate of material removal and the flow rate of the pumped water.

SUMMARY OF THE INVENTION

The exemplary system and apparatus of the present invention substantially decreases the effect of this limitation by using an eductor to enhance the effect of the water pumped through the submerged hydraulic jets. An elongate, transverse array of spaced, parallel-oriented jets adapted to produce a substantially planar flow above a bed of sedimentary material has an eductor plate located down-flow from the jet outlets, the eductor plate extending generally parallel to the transverse array and to the direction of flow and spaced above the jet outlets. The eductor plate defines an elongate, transverse orifice above the array of submerged jets creating a region of increased fluid velocity and decreased pressure below the eductor orifice. Surrounding water from above the jets is pulled down through the orifice by the region of decreased pressure, adding fluid volume to the jet flow without requiring its passage through the pump and enhancing the eroding capability of the combined flow. The eductor plate also provides an upper boundary for the jet flow, thereby more efficiently directing and utilizing the combined flow.

Accordingly, it is a principal objective of the present invention to provide an improved hydraulic dredging system.

It is a particular objective of the present invention to provide a system which is adapted to remove submerged sandwaves.

It is another object to provide such a system which includes a large transverse array of parallel, spaced, submerged jets to dredge or remove material in an exceptionally wide swath for high productivity, without requiring a proportionately large and powerful pumping unit.

It is a further object to provide a hydraulic dredging system which employs an eductor to enhance the eroding capability of the hydraulic jets.

It is an associated object to provide a hydraulic dredging apparatus having transversely spaced jets extending in an array at least as wide as the width of the supporting vessel.

It is a further object to provide such an array which is suspended above the bottom of the body of water.

The foregoing and other objectives, features and advantages of the present invention will be more readily understood upon consideration of the following detailed description of the invention taken in conjunction with the accompanying drawings.

DETAILED DESCRIPTION OF THE INVENTION

Figure 1:
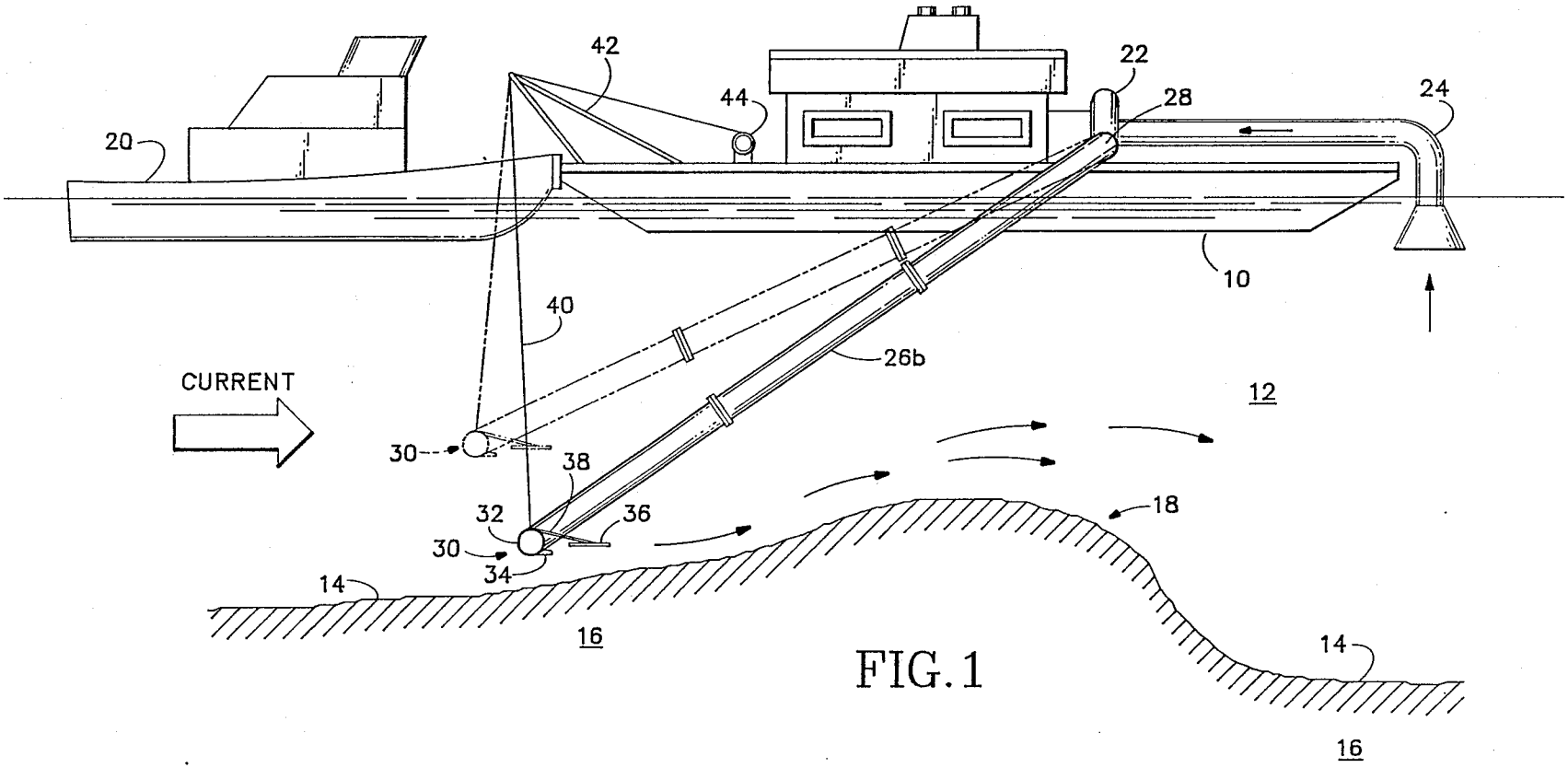
FIG. 1 is a side pictorial view of an exemplary arrangement of the system of the present invention in use.
Figure 2:
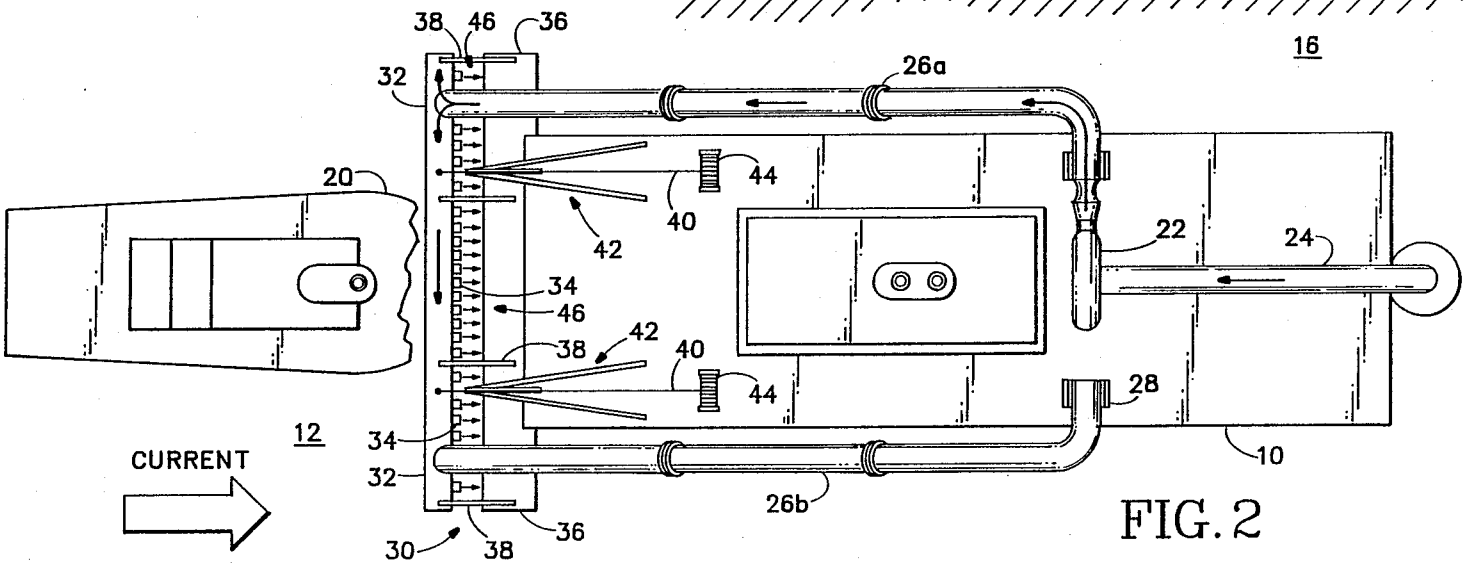
FIG. 2 is a top pictorial view of the system of FIG. 1.

Referring to FIGS. 1 and 2, a barge 10 carrying an exemplary system according to the present invention is shown afloat in a river 12 above a riverbed 14 comprised of sedimentary material 16 such as sand, mud, silt, or gravel. A sandwave 18 is shown projecting above the riverbed posing a potential hazard to navigation. A tug boat 20 is made up to the stern of the barge and controls movement of the barge and its system within the stream. For the purpose of explaining the invention described herein, the stream is considered to have a current represented by the broad arrows in the figures.

The portion of the exemplary system aboard the barge includes a pump 22 which draws water through an intake pipe 24 forward of the pump and forces the water, under pressure, through one of a pair of trailing arms **26*a* and 26*b*. As may be seen in FIG. 2, trailing arm 26*a* consists of multiple sections of pipe, including an L-shaped section which is pivotably connected to the outflow of the pump so that water from the pump is forced into trailing arm 26*a* as shown by the small arrows. Like trailing arm 26*a*, trailing arm 26*b* also consists of sections of pipe, the forward section being L-shaped and pivotally connected to a fitting 28** on the deck of the barge for rotating about a horizontal axis transverse to the length of the barge.

Figure 3:
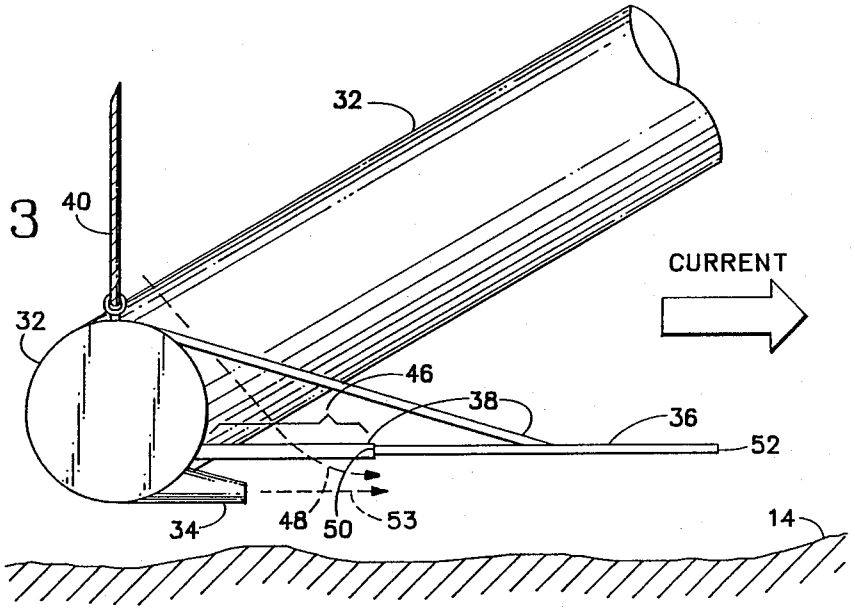
FIG. 3 is an enlarged side view showing a jet and the eductor plate.

When operative, the trailing arms slant downwardly past the stern of the barge as shown in FIG. 1 and support a submerged fluidizer bar assembly 30 which extends transversely between the trailing arms. The fluidizer bar assembly includes a transversely-elongate manifold 32 which receives the water from the interior of trailing arm **26*a*, but does not communicate, with the interior of arm 26*b*. A transversely-elongate eductor plate 36 is attached to, and spaced down-current from the manifold by a plurality of upper and lower supporting struts 38 as best seen in FIG. 3. The manifold includes a plurality of transversely spaced-apart, parallel-oriented jet nozzles 34**.

The trailing arms and fluidizer bar assembly are suspended above the riverbed 14 by a pair of cables 40 which are attached to the manifold and supported over a pair of hoists 42 extending out over the stern of the barge. The depth of the fluidizer bar assembly may be finely adjusted by a pair of winches 44 which can selectively take in or pay out cable to adjust the position of the assembly with respect to the riverbed. The depth may also be adjusted in larger increments by adding or deleting sections of pipe which make up the trailing arms.

As shown in FIG. 2, the water from the pump 22 is forced down trailing arm 26a and into the manifold 32 where it leaves the manifold at substantial velocity through the array of parallel oriented jet nozzles. In the exemplary embodiment, trailing arm 26b does not carry any water. As shown in FIG. 3, the water forceably expelled from the array of jets 34 creates a substantially planar primary flow 52, in a direction downstream from the jets, which is substantially parallel to the riverbed 14. The velocity of the water in the flow is substantially greater than the parallel flowing current of the river, although the velocity is greatest at the jet nozzles and decreases further away from the nozzles. According to well recognized principles of fluid dynamics, the jet nozzles each act as ejectors, using the kinetic energy of the primary flow to "pump" surrounding water along with it. This is caused by the tendency of the surrounding fluid to flow toward a region of lower pressure caused by the increased velocity of the primary flow. Accordingly, although the primary flow diffuses and its velocity decreases as its distance from the nozzles increases, the rate of the flow, expressed in volume per time, actually increases. Unfortunately, this "pumping" effect is normally very inefficient. However, by arranging the eductor plate 36 so as to provide a transversely-extending orifice above the jet outlets, it is enhanced significantly.

As seen in FIG. 2, the eductor plate is elongate and arranged substantially parallel both to the elongate manifold and to the direction of the primary flow so as to form a transversely elongate orifice 46 between the eductor plate and the manifold in a location above and down-flow of the jet outlets. With the fluidizer bar submerged as shown in FIG. 3, the stream bed provides a lower boundary for the primary flow 53 generated by the jets. The eductor plate 36 forms an upper boundary for the flow, its placement above the primary flow creating a region of increased velocity and decreased pressure beneath the eductor plate. Surrounding water at higher pressure tends to flow toward the region of lower pressure. However, the region is bounded below by the stream bed, and above by the eductor plate and manifold. Further, since the region beneath the eductor plate is transversely elongate with minimal vertical height, the amount of water pulled into the flow at the unbounded edges of the region is minimal. The orifice 46 between the manifold and eductor plate provides a restricted opening, transversely coextensive with the jet array and the primary flow, for enabling surrounding water to be pulled into the flow. Restricting the opening through which the surrounding water can enter the flow has the effect of accelerating a secondary flow 48 down through the orifice 46. Thus, not only does the eductor plate help maintain the velocity of the flow by providing an upper boundary to prevent upward diffusion of the primary flow generated by the jet nozzles, but the restricted orifice between the plate and the manifold results in increasing the velocity of the surrounding water which joins with the primary flow.

Referring still to FIG. 3, the eductor plate has an edge 50 proximate the jets and another edge 52 remote from the jets. The eductor plate serves to maintain the velocity of the flow as high as possible past the edge 52, while increasing the overall flow rate by adding water to the flow thus enhancing the ability of the flow to dislodge and carry away sedimentary material 16 from the stream bed 14. The secondary flow 48 has a downward component. This downward component, along with any boundary layer which may be created on the underside of the eductor plate, has a tendency to direct the combined flow (primary flow and secondary flow) downwardly toward the riverbed further enhancing the digging effect of the combined flow upon the sedimentary material. Once the sedimentary material has been dislodged from the riverbed and entrained in the combined flow, the remnants of the combined flow, along with the current, carry the material downstream where it is dropped out of the current when the current slows in deeper water.

An exemplary fluidizer bar according to the present invention is as wide as or wider than the width of the supporting vessel 10, e.g. more than 60 feet long having 21 jets spaced at 3-foot intervals, each jet having a nozzle area of 0.05 square feet. The total flow through the nozzles is approximately 65 cubic feet per second. The exit velocity of the water at the nozzles is approximately 65 feet per second with the velocity decreasing to approximately 15 feet per second as the combined flow passes the edge 52 of the eductor plate. However, due to the eductor principles explained above, the rate of flow past the edge 52 of the plate can be as high as 800 cubic feet per second, more than ten times the flow rate of the water which is ejected from the nozzles alone.

The pipes which make up the trailing arm 26a and the manifold of the exemplary eductor system are 2½ feet in diameter. A 24-inch dredge pump powered by a power unit having approximately 1500 horsepower creates a dynamic pressure head of 100 feet at the manifold. Due to the large diameter pipe, the relatively low velocity of the water within the pipe, and the relatively short length of pipe through which the water must travel (approximately 120 feet), friction losses in the pipe are small. It is important that the tug 20 controlling the barge have a propeller thrust in excess of the thrust of the array of jet nozzles, which is approximately 8,000 pounds, in order to enable the tug to maneuver the barge in the river. Drag anchors attached to the fluidizer bar may be employed to stabilize the fluidizer bar, hold the barge on line, and resist the surface current.

In operation, the exemplary fluidizer bar assembly is positioned between 1–2 feet above the stream bed. The eductor plate itself is approximately 8 feet wide, with the edge 50 of the plate spaced approximately 4 feet from the manifold and the other edge 52 spaced approximately 12 feet from the manifold. In this configuration, taking into consideration the boundary layer created along the riverbed, the eductor system produces a zone of reasonably high velocity flow, approximately 10–15 feet per second, near the stream bed to entrain the bed material and transport it downstream. After the flow exits from under the plate, it would diffuse upwardly, providing a broad zone of transport for the sedimentary material. As shown in FIG. 1 an upwardly projecting sandwave downstream of the fluidizer bar would also serve to deflect the sediment-carrying flow upwardly.

The system is used by starting upstream of a sandwave and moving the fluidizer bar assembly downstream over the sandwave at a velocity of approximately 2 feet per second. For the exemplary system described above, approximately 1 foot of sand 60 feet wide could be removed during each pass. The depth of material removed will depend upon the coarseness of the material being removed, the length of the "sandwave," and the velocity of the natural currents.

Although the exemplary system has been described with respect to a sandwave in a riverbed having a current, it is contemplated that the system of the present invention would also be appropriate for use on sedimentary beds of ponds, lakes, harbors and the like.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. An apparatus for moving submerged sedimentary material comprising:

(a) a plurality of fluid jets having parallel-oriented outlets spaced apart in a transverse direction;

(b) means for pumping a fluid under pressure through said jets in a flow direction generally perpendicular to said transverse direction for producing a directional flow in a surrounding fluid, said transverse direction and flow direction defining a flow plane; and (c) a transversely-elongate plate extending down-flow from the outlets of said jets and located above said outlets, and a transversely-elongate member located up-flow from the outlets of said jets and spaced from said transversely-elongate plate, said plate and said member defining therebetween a transversely-extending orifice above said outlets having a lowermost extremity extending along said flow direction between transversely-extending orifice boundaries located up-flow and down-flow, respectively, of said outlets for conducting a restricted flow of said surrounding fluid toward said flow plane in a downward direction.

2. The apparatus of claim 1 wherein said plate comprises means for cooperating with said jets to create an area of greater fluid velocity and lesser fluid pressure below said orifice means than above said orifice means.

3. The apparatus of claim 1 wherein said jets and said plate comprise eductor means for drawing said surrounding fluid from above said jets into said directional flow.

4. The apparatus of claim 1, including a transversely-elongate structural member proximate said jets, said plate being spaced down-flow from said structural member so as to define said orifice means therebetween.

5. The apparatus of claim 4 wherein said structural member comprises a fluid manifold interconnecting said jets.

6. The apparatus of claim 1 wherein said plate extends generally parallel to said flow plane.

7. The apparatus of claim 6 wherein said plate is substantially planar.

8. The apparatus of claim 1 wherein said plate comprises means for directing said directional flow downwardly.

9. The apparatus of claim 1, further including support means for supportably suspending said jets and said plate independently of any support from said sedimentary material.

10. The apparatus of claim 9 wherein said support means includes means for selectively raising or lowering said jets and said plate with respect to said sedimentary material.

11. A method for moving submerged sedimentary material having a submerged upwardly-facing surface, said method comprising:

(a) arranging a plurality of fluid jets in an elongate, transversely-spaced array having parallel-oriented fluid outlets so that fluid ejected therefrom defines a transversely-extending, substantially planar flow;

(b) submerging said array with said fluid outlets vertically spaced above said surface of said sedimentary material so that said flow will disturb said sedimentary material;

(c) submerging a transversely elongate plate down-flow from said outlets and above said outlets so as to define at least one transversely-extending submerged orifice above said outlets;

(d) creating a region of greater fluid velocity and lesser fluid pressure beneath said orifice than above said orifice by ejecting fluid from said outlets while said outlets are vertically spaced above said surface of said sedimentary material; and (e) thereby causing fluid from above said orifice to pass downwardly through said orifice and be carried along with said flow.

* * * * *